US006942299B1

(12) United States Patent
Sardo

(10) Patent No.: US 6,942,299 B1
(45) Date of Patent: Sep. 13, 2005

(54) PADDED VANDALISM RESISTANT DISPOSABLE VEHICULAR SEATING INSERT SYSTEM

(76) Inventor: Louis Sardo, 1629 Verdugo Blvd., La Canada, CA (US) 91011

( * ) Notice: Subject to any disclaimer, the term of this patent is extended or adjusted under 35 U.S.C. 154(b) by 145 days.

(21) Appl. No.: 10/408,830

(22) Filed: Apr. 7, 2003

Related U.S. Application Data

(63) Continuation-in-part of application No. 09/961,978, filed on Sep. 24, 2001, now Pat. No. 6,736,454.

(51) Int. Cl.[7] ..... A47C 7/02
(52) U.S. Cl. ..... 297/452.55; 297/440.22; 5/653
(58) Field of Search ..... 297/219.1, 228.13, 297/229, 232, DIG. 6, 452.28, 452.55, 452.58, 297/452.59, 461, 440.14, 452.27, 452.6, 297/440.22; 5/653, 411, 655.9, 922

(56) References Cited

U.S. PATENT DOCUMENTS 3,111,689 A * 11/1963 Mulhauser, Jr ..... 297/452.48
3,198,578 A * 8/1965 Hoppe et al. ..... 297/452.57
3,556,594 A * 1/1971 Anderson ..... 297/452.59
3,797,887 A * 3/1974 Barecki et al. ..... 297/452.19
3,801,154 A * 4/1974 Hultquist et al. ..... 297/218.1
4,607,887 A * 8/1986 Vail ..... 297/452.26
4,917,931 A * 4/1990 McDowell et al. ..... 428/88
4,955,095 A * 9/1990 Gerrick ..... 5/691
5,061,539 A * 10/1991 McDowell et al. ..... 428/85
5,405,179 A * 4/1995 Jih ..... 297/452.49
5,407,247 A * 4/1995 Forcier et al. ..... 297/229
5,487,587 A * 1/1996 Hylton ..... 297/219.1
5,503,454 A * 4/1996 Sakamoto ..... 297/218.1
5,704,691 A * 1/1998 Olson ..... 297/452.55
5,826,939 A * 10/1998 Beyer ..... 297/218.3

* cited by examiner

*Primary Examiner*—Peter M. Cuomo
*Assistant Examiner*—Stephen Vu
(74) *Attorney, Agent, or Firm*—Goldstein Law Offices PC.

(57) ABSTRACT

A vandalism resistant seating insert for mounting to a vehicle seat assembly having at least one vehicle seat frame having a ledge which defines a central opening. The seating insert has a rigid spine having a front surface and a periphery, a back plate having a rear surface and a periphery, and a cushion extending between the rigid spine and back plate. The back plate has a securing means for attaching to the ledge of the vehicle seat frame. A fabric covering is adhered to the rigid spine front surface and is wrapped over the periphery of the rigid spine and back plate, and is attached to the rear surface of the back plate.

9 Claims, 5 Drawing Sheets

PADDED VANDALISM RESISTANT DISPOSABLE VEHICULAR SEATING INSERT SYSTEM

CROSS REFERENCES AND RELATED SUBJECT MATTER

This application is a continuation-in-part of patent application Ser. No. 09/961,978, filed in the United States Patent Office on Sep. 24, 2001 issued as U.S. Pat. No. 6,736,454 on May 18, 2004.

FIELD OF THE INVENTION

The invention relates to a padded, vandalism resistant, disposable vehicular seating insert system. More particularly, the invention relates to a seating insert which may be detachably secured to a vehicular seating frame, providing an addition level of comfort thereto, while resisting destruction from vandals.

BACKGROUND OF THE INVENTION

Traditional vehicular seats, namely those seats employed by commuter buses and coaches, are often comprised of a hard material such as fiberglass or high-impact synthetic resins and plastics. These materials are often employed due to their resilient nature—they are not vulnerable to destruction due to intentional vandalism or high-volume commuter wear and tear. Furthermore, seats of this construction are also easily maintained in that they may be readily scrubbed with harsh abrasives to remove stains and markings, without obvious damage to the seat's finish.

However, while seats of this construction are easily maintainable, they tend to fail to provide even the slightest level of comfort to a commuter seated thereupon. The rigid construction can cause upper and lower back pains after short periods of time, as well as discomfort to the user's buttocks and thighs. A seating surface which employs softer and more cushioned seating surfaces is needed. Unfortunately, to construct commuter bus or coach seats of a more flexible and soft supple cloth-like material, as is often encountered in small passenger vehicles is not feasible since these types of seats are easily damaged, cut, and marred. To replace an entire such seat assembly in response to damage, cutting or marring would be extremely cost prohibitive. Accordingly, a device or system is needed which permits a commuter bus or coach seat to provide comfort to a user, without all of the problems inherent in the systems mentioned above.

In recent years, seating inserts have been used which a rigid spine is covered with a fabric, carpet-like pile, and then is attached to the seat frame. Such inserts marginally improve the comfort for the rider. In addition, because the fabric covering is glued directly to the rigid spine, a vandal can perhaps scrape through the fabric with a knife, but the rigid spine will prevent the vandal from doing little more than making a fine cut-line in the fabric pile.

The problem with such inserts, is that although the fabric pile provides a more attractive seat, which is soft on the surface, it fails to provide adequate cushioning for the rider. The obvious solution would be to provide a cushion between the fabric pile and the rigid spine. However, a simple cut from the vandal's knife would destroy such a seat. Accordingly, attempts to cushion such an insert have been coupled with attempts to prevent a vandal's knife from moving through the cushion—such as by putting a metal mesh within the foam, or a metal mesh in the fabric covering. All such attempts are easily defeated with sufficient strength and determination on the part of the vandal, and thus have been largely unsuccessful.

Some buses have a newer seat design, which provides a frame-like support, which only supports a seating insert along its edges, and defines a central opening within the frame-like support. The present application seeks to provide an effective solution which provides a vandal resistant seating insert, while providing a comfortable riding experience to the passenger. Accordingly, while these prior art units described herein may be suitable for the particular purpose employed, or for general use, they would not be as suitable for the purposes of the present invention as disclosed hereafter.

SUMMARY OF THE INVENTION

The present invention relates to a padded vehicular seating insert system. More particularly, the invention relates to a seating insert which may be detachably secured to a fixed vehicular seating assembly, providing an addition level of comfort thereto.

In accordance with the invention, there is provided a seating insert which may be easily removed from a bus or coach seat in the event said insert needs to be cleaned or replaced.

Further in accordance with the invention, there is provided a seating insert which employs a rigid, vandal resistant spine, but still has enhanced comfort, by providing a cushion in addition to the fabric pile which covers the rigid spine.

It is yet a further object of the invention to allow the insert to be installed to a seat frame which has a frame-like ledge that define a central opening. Accordingly, the cushion is located behind the rigid spine in a rear recess. A back plate extends behind the rigid spine such that the cushion is located between the rigid spine and back plate.

Further in accordance with the invention, the invention is a vandalism resistant seating insert for mounting to a vehicle seat assembly having at least one vehicle seat frame having a ledge which defines a central opening. The seating insert has a rigid spine having a front surface, a rear surface having a rear surface recess, and a periphery. The seating insert has a back plate having a rear surface and a periphery, and a cushion extending between the rigid spine and back plate in the rear surface recess of the rigid spine. The back plate has a securing means for attaching to the ledge of the vehicle seat frame. A fabric covering is adhered to the rigid spine front surface and is wrapped over the periphery of the rigid spine and back plate, and is attached to the rear surface of the back plate. The cushion is located within the rear recess of the rear surface of the spine so that it is not subject to vandalism.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
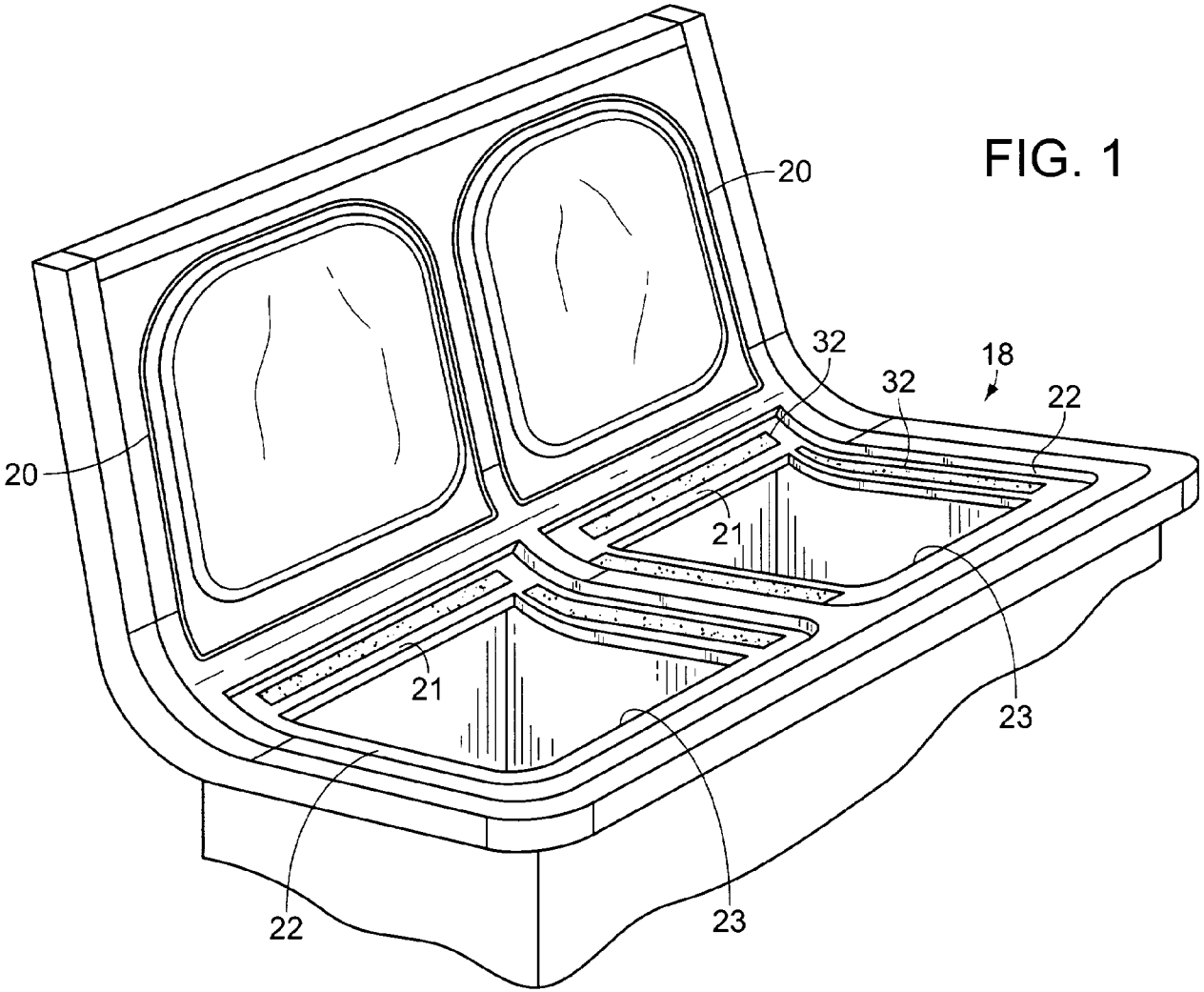
FIG. 1 is a diagrammatic perspective view of a vehicle seat assembly for use with the instant invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the seat insert. The words "proximal end" and "distal end" refer, respectively, to ends of an object nearer to and further from the operator of the object when the object is used in a normal fashion or as is described in the specification.

Figure 5:
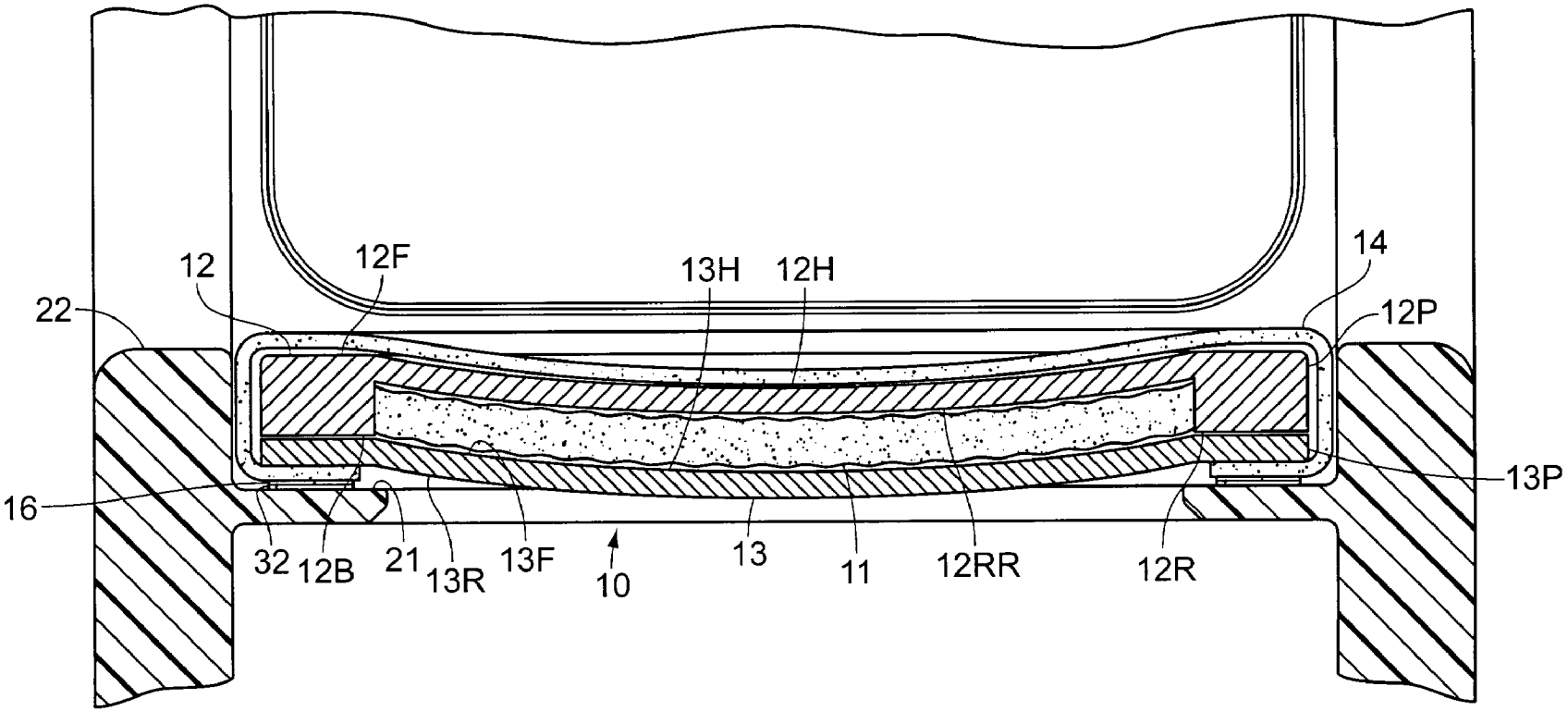
FIG. 5 is a cross sectional view of the seating insert, wherein the rigid spine, back plate, fabric pile, and cushion all have exaggerated thickness for illustrative purposes.

Referring to FIG. 5, in its most general terms, the invention is a seating insert 10, which includes a rigid spine 12, a back plate 13, a fabric covering 14, and a cushion 11, which are each present throughout the drawing figures. It should be noted, however, that the thicknesses of the spine 12, back plate 13, cushion 11, and even the fabric covering 14 are greatly exaggerated for illustrative purposes. In reality, for example, the cushion 11 is approximately ¼ inch thick, while the rigid spine 12 and back plate 13 might be approximately twelve to sixteen inches square. In addition, the fabric covering 14 is consistently adhered to the spine 12 and back plate 13, but is shown spaced slightly therefrom for illustrative clarity.

The rigid spine 12 is preferably made of ABS plastic, which is hard, resistant to cutting, and generally rigid. In particular, the rigid spine 12 has a front surface 12F, a rear surface 12R which is visible in some others, and has a periphery 12P. The rigid spine 12 also has a rear recess 12RR which extends toward the front surface 12F from the rear surface 12R. A rigid spine border 12B surrounds the rear recess 12RR. The rigid spine 12 has a spine front hollow 12H which curves rearward in the region overlapping the rear recess 12RR. The back plate 13 has a back plate front 13F that rests flush against the rigid spine rear 12R, a back plate periphery 13, and a back plate rear 13R. The back plate 13 also has a back plate hollow 13H which curves rearward substantially parallel to the spine front hollow 12H.

The insert 10 is well suited for use with a typical fixed vehicle seat assembly 18 shown in FIG. 1, which may be present on a bus, a train, or other public conveyance or public vehicle. The seat assembly includes a pair of seat frames, including an upper seat frame 20 and a lower seat frame 22. Each of the seat frames 20, 22 has a ledge 21 of substantially uniform width, and defines a central opening 23. Ordinarily, a cushioned seat is inserted into each of the upper and lower seat frames 20, 22, for supporting a passenger's back and buttocks, respectively. Unfortunately, such cushioned seats are highly vulnerable to vandalism and are unsuitable for use in public transportation vehicles used in many urban areas. Such cushioned seats have been removed from the lower seat frames 22 in FIG. 1 to help illustrate installation of the seat insert 10 of the present invention in conjunction with these vehicle seat assemblies 18. In particular, for use with the present invention, securement means 32 are present upon the ledge 21 of each of the frames 20, 22, which preferably comprise hook and loop fastener material to allow simple installation and removal of the seat insert therein, as will be described in further detail hereinafter.

Figure 2:
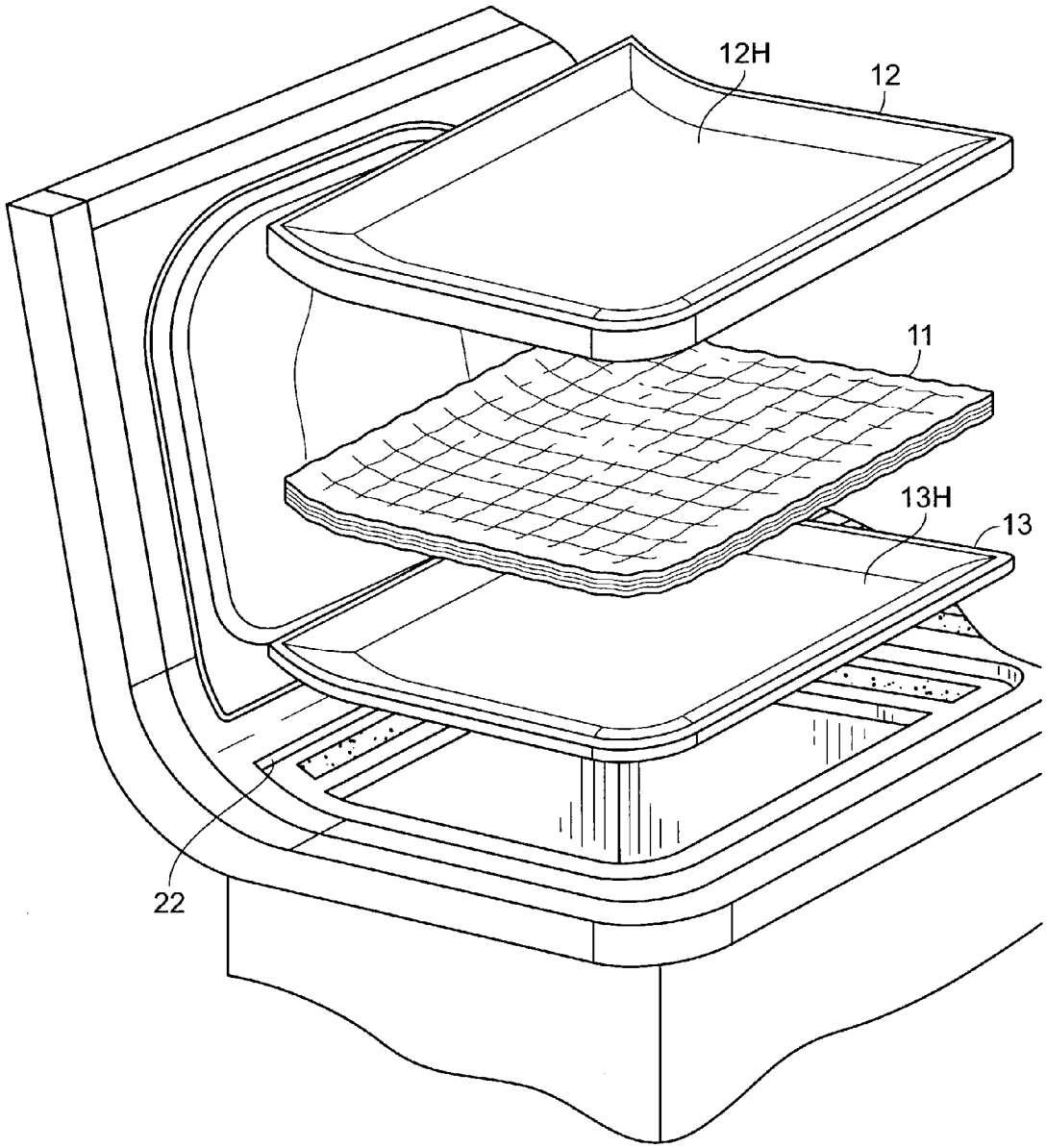
FIG. 2 is an exploded view of the seating insert, illustrating major internal components of the seating insert—all of which are exaggerated in thickness—and their relative orientation with respect to the vehicle seat assembly.

FIG. 2 illustrates the relative positioning of the rigid spine 12, the back plate 13, and the cushion 11 therebetween. Clearly, the back plate 13 is positioned closest to the lower seat frame 22 and is in fact supported by the ledge 21. Also, clearly the rigid spine is located at an upper position where it is closest to a passenger who will use the vehicle seat. Accordingly and unexpectedly, the cushion 11 is not mounted closest to a passenger who will sit atop the rigid spine 12—but is located beneath the rigid spine 12, and in particular between the rigid spine 12 and the cushion 11.

Referring again to FIG. 5, when seated upon the seating insert 10, the passenger's weight is supported primarily by the rigid spine 12 upon its front surface 12F, is transferred to the back plate 13 by the rear surface 12R of the rigid spine along its periphery 12P, and is transferred thereby to the ledge 21 of the seat frame 20. The cushion 11, extending within the rear recess 12RR unexpectedly provides additional comfort to the user, in part by damping vibrations which would otherwise be transmitted to the rigid spine 12 when the vehicle travels over a bump or uneven pavement.

Figure 3:
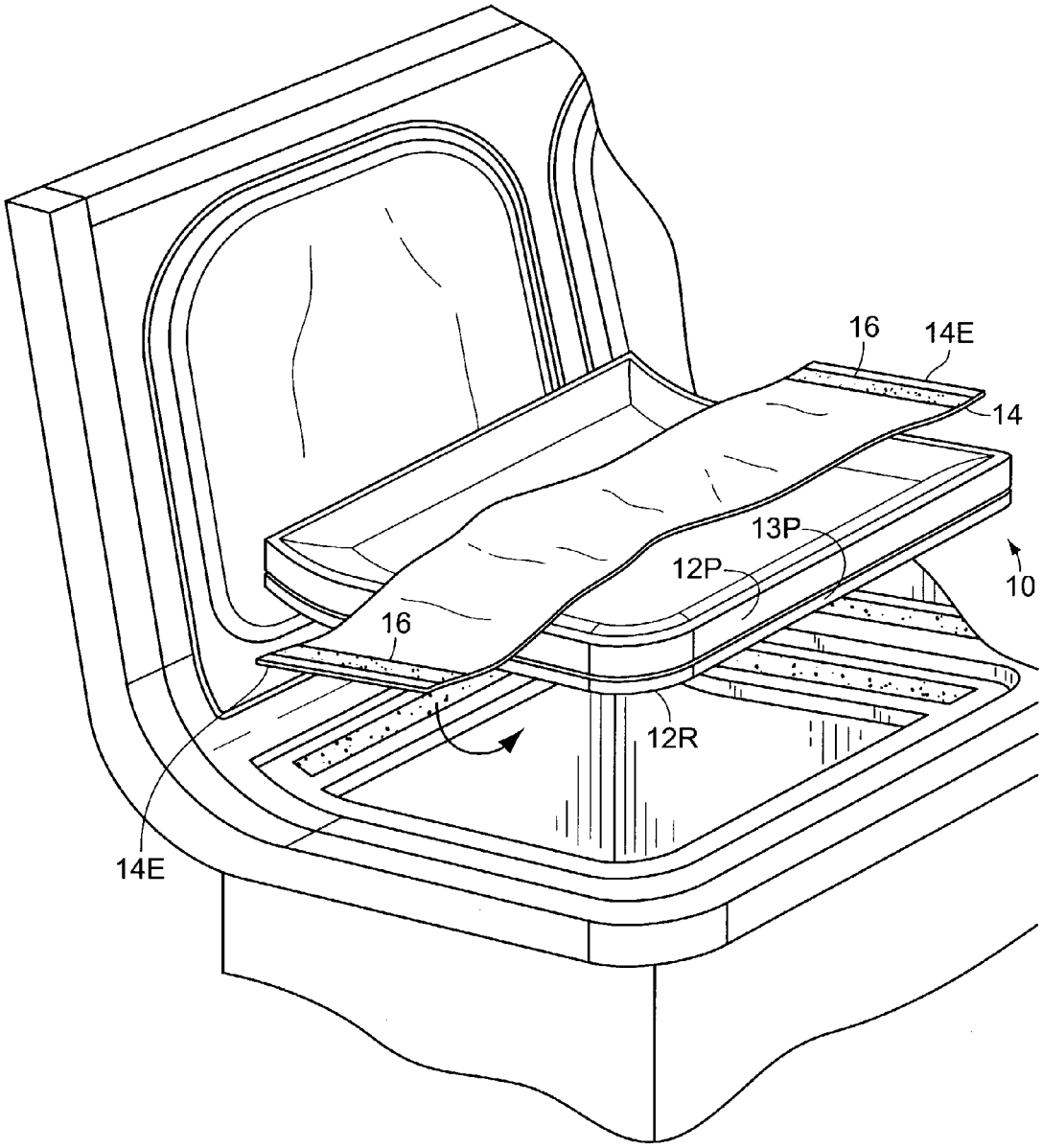
FIG. 3 is a diagrammatic perspective view, generally illustrating the installation of the fabric pile around the rigid spine and the back plate.

To enhance the aesthetics of the insert 10, and to keep the rigid spine 12 and back plate 13 together, the fabric covering fully spans and is adhered to the front surface 12F of the rigid spine 12, folds over and is adhered to the peripheries 12P, 13P of the rigid spine 12 and back plate 13, and extends to the back plate rear 13R where it is finally adhered near the periphery 13P of the back plate 13. In general, the fabric covering 14 is consistently adhered to all surfaces over which it extends. This is especially important on the front surface 12F of the rigid spine 12, so that if a vandal attempts to cut the fabric covering 14 with a knife, they might create a linear cut in the fabric, but since the fabric on either side of that linear cut is adhered to the rigid spine 12, at best they will provide a 'scrape' in the fabric covering. The soft fabric covering 14 is generally a carpet-like wool pile. As seen in FIG. 5, the insert 10 is attached to the seat frame 22 with strips of securing means 16 such as hook and loop fasteners 16 are disposed on the rear surface 13R of the back plate 13, which mate with the securement means 32 on the ledge 21 of the seat frame 20. More particularly, the securing means 16 are positioned on an outer side of the fabric covering 14 as it wraps around to the rear surface 13R. FIG. 3 illustrates a preferable manner of assembling the seat insert 10, wherein the hook and loop fasteners of the securing means 16 are already sewn or otherwise attached near edges 14E of a 'broken away' piece of the fabric covering 14 before it is extended over the spine 12 and back plate 13. Accordingly, once the fabric covering 14 is adhered in place, the securing means 16 will be naturally positioned below the back plate 13 and oriented rearward therefrom. To facilitate assembly of the seating insert 10, the fabric covering 14 can be precut as a rectangle sized to fit over the spine front surface 13F, with 'flaps' that extend perpendicularly outward from the sides of said rectangle in a 'plus' configuration to extend over the peripheries 12P, 13P and then adhere to the back panel rear surface 13R.

Figure 4:
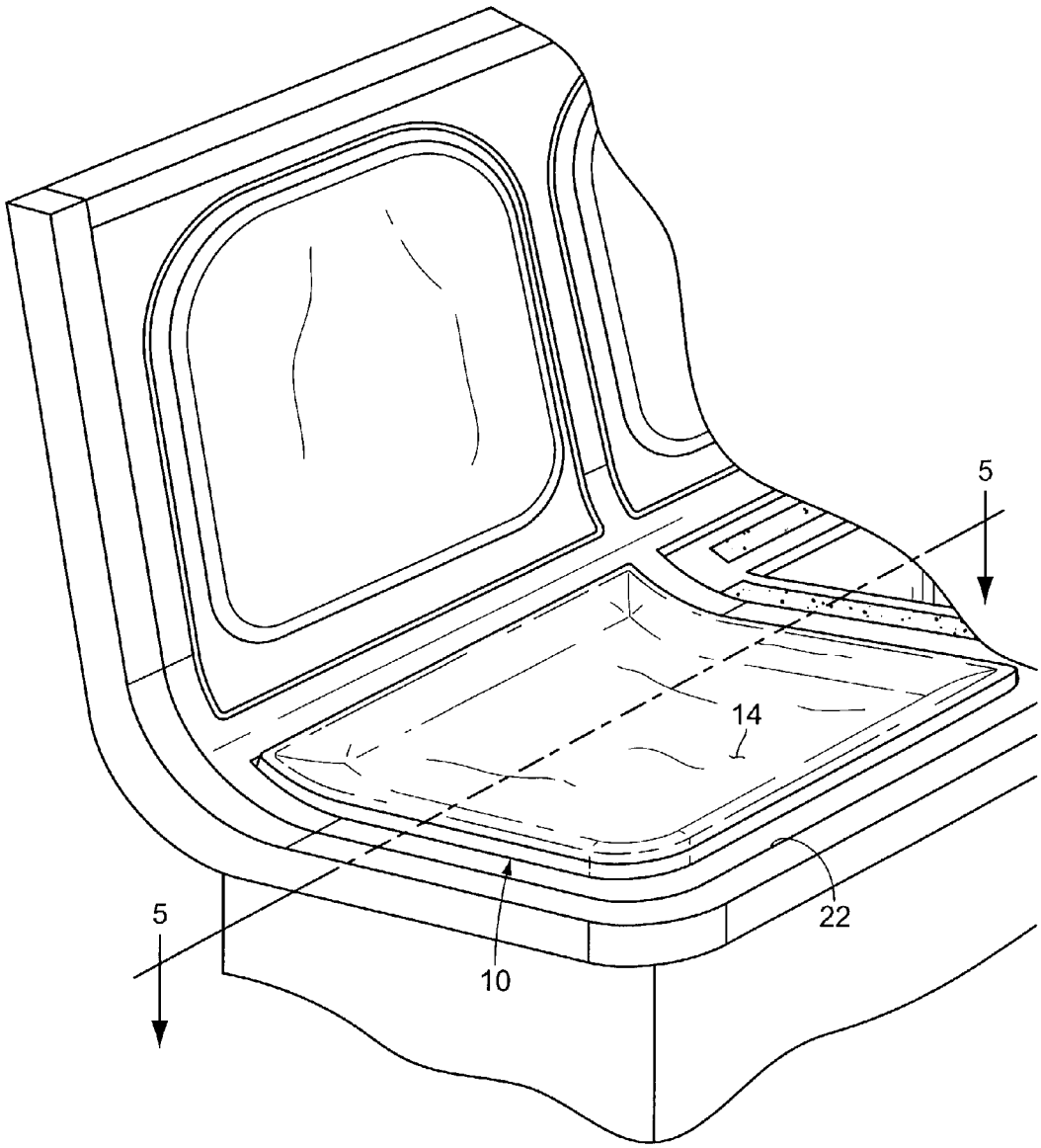
FIG. 4 is a diagrammatic perspective view, illustrating the seating insert fully installed to one seat frame of the vehicle seat assembly, alongside an empty seat frame thereof.

FIG. 4 illustrates the seating insert 10, fully assembled, covered with the fabric covering 14, and mounted within the lower seat frame 22.

Referring generally to FIGS. 1–5, preferably ¼" thick water resistant foam is used for the cushion 15, although the foam could be substituted in numerous ways, such as with rubber or a waffled plastic pad. Further, the covering 14 is glued consistently across the front surface 12F, is glued to the peripheries 12P, 13P, and is glued to the rear surface 13R of the back plate 13. Once installed, the cushion 15 provides additional comfort for the user. Although contact with the rigid spine 12 by the passenger is not itself softened by the cushion 15—even the small travel (generally ¼") afforded by the cushion goes a long way to absorb vibration, shocks during motion of the vehicle—and unexpectedly provides significant comfort to the passenger seated thereupon.

As seen in FIG. 2, generally the hollows 12H and 13H in the spine 12 and back plate 13 are concave, and have substantially parallel curvatures. In general the spine 12 and back plate 13 are substantially parallel and together provide a seating insert which is substantially parallel between the front surface 12F of the spine 12 and the rear surface 13R of the back plate 13. The covering 14 is conformed to 'skin' the rigid spine 12 and periphery of the rigid spine 12 and back plate 13. The resulting seating insert 10 is easily installed into the vehicle seating assembly 18, will provide passenger comfort while resisting vandalism for a long useful life, and then is easily removable for rehabilitation of the seating assembly 18.

In conclusion, herein is presented a seating insert with use with a vehicle seating assembly which has a frame having a ledge which defines a central opening, wherein the seating insert is supported upon the ledge and a cushion is provided to enhance comfort without sacrificing the vandal resistance of the insert. This concept is embodied in the form illustrated in the accompanying drawings. However such drawings are illustrative only. Numerous variations may be made while adhering to the inventive concept. Such variations are contemplated as being a part of the present invention.

What is claimed is:

1. A seating insert for use with a vehicle seating assembly, having at least one seat frame having a ledge defining an opening, comprising:

a rigid spine having a front surface, a rear surface, and a periphery;

a back plate, having a front surface, a rear surface, and a periphery, the back plate extending behind the rear surface of the rigid spine substantially parallel thereto with the back plate periphery substantially aligned with the rigid spine periphery;

a fabric covering upholstered across the front surface of said rigid spine and adhered directly to said front surface; and a cushion, extending between the rear surface of the rigid spine and the front surface of the back plate; and a securing means attached to the rear surface of the back plate, for attaching the seating insert to the vehicle seat frame ledge.

2. The seating insert as recited in claim 1, wherein the rigid spine has a rear surface recess, extending forwardly into the rear surface, and the cushion extends within the rear surface recess.

3. The seating insert as recited in claim 2, wherein the rigid spine has a border around the rear surface recess that extends flush against the front surface of the back plate.

4. The seating insert as recited in claim 2, wherein the rigid spine has a border around the rear surface recess that extends flush against the front surface of the back plate.

5. The seating insert of claim 4, wherein the vehicle seat frame ledge has a securement means having hook and loop fastener material; wherein the securing means of the seating insert is hook and loop fastener material; and wherein that the hook and loop fastener material on the seating insert can engage the hook and loop fastener material on the vehicle seat frame ledge.

6. The seating insert of claim 4, wherein the vehicle seat frame ledge has a securement means having hook and loop fastener material; wherein the securing means of the seating insert is hook and loop fastener material; and wherein that the hook and loop fastener material on the seating insert can engage the hook and loop fastener material on the vehicle seat frame ledge.

7. The seating insert of claim 6, wherein the fabric covering wraps around the rigid spine periphery and back plate periphery from the front surface of the rigid spine onto the rear surface of the back plate and is secured onto said rear surface of the back plate.

8. The seating insert as recited in claim 1, wherein the rigid spine has a rear surface recess, extending forwardly into the rear surface, and the cushion extends within the rear surface recess.

9. A seating insert for use with a vehicle seating assembly, having at least one seat frame having a ledge defining an opening, comprising:

a rigid spine having a front surface, a rear surface, and a periphery;

a back plate, having a front surface, a rear surface, and a periphery, the back plate extending behind the rear surface of the rigid spine substantially parallel thereto with the back plate periphery substantially aligned with the rigid spine periphery;

a fabric covering spanning the front surface of said rigid spine, adhered directly to said front surface, and wrapping around the periphery of the rigid spine and periphery of the back plate toward the rear surface of the back plate; and a cushion, extending between the rear surface of the rigid spine and the front surface of the back plate; and a securing means attached to the rear surface of the back plate, for attaching the seating insert to the vehicle seat frame ledge.

* * * * *